US006789695B1

(12) United States Patent
Gaudreau

(10) Patent No.: US 6,789,695 B1
(45) Date of Patent: Sep. 14, 2004

(54) DOOR HANDLE DISINFECTING/COVER DISPENSING SYSTEM

(76) Inventor: Benjamin S. Gaudreau, 4780 131st St., Suite 20, Omaha, NE (US) 68137-1864

( * ) Notice: Subject to any disclaimer, the term of this patent is extended or adjusted under 35 U.S.C. 154(b) by 0 days.

(21) Appl. No.: 10/377,635

(22) Filed: Mar. 4, 2003

(51) Int. Cl.[7] ..... A47F 1/00
(52) U.S. Cl. ..... 221/102; 206/449
(58) Field of Search ..... 221/33, 45, 48, 221/102, 63, 97; 206/449, 494, 812, 824, 223; 49/70

(56) References Cited

U.S. PATENT DOCUMENTS 1,633,988 A 6/1927 Jones
3,343,578 A 9/1967 Rubin
4,436,224 A 3/1984 McInerny
4,644,689 A * 2/1987 Arians ..... 49/70
4,997,139 A 3/1991 Menard
5,495,641 A 3/1996 Going et al.
5,577,635 A * 11/1996 Block ..... 221/45
5,647,248 A 7/1997 Silsby, Jr.
5,687,875 A 11/1997 Watts et al.

* cited by examiner

*Primary Examiner*—Kenneth Noland
(74) *Attorney, Agent, or Firm*—Donald R. Schoonover

(57) ABSTRACT

A handle of a door is covered by a disposable tissue when that handle is used to open the door. The tissue is dispensed from a housing mounted on the door superadjacent to the handle. Tissues from the housing are sized so the tissue will remain attached to the housing but will cover the handle. Disinfectant can be sprayed onto a handle before the handle is grasped via the tissue. Once the door is opened, a user simply pulls the tissue out of the housing and discards it. As one tissue is pulled out of the housing, that tissue pulls the next tissue out of the housing.

3 Claims, 2 Drawing Sheets

68
62
60
94
70
78
82
12

82
72
60
62
68
94
76
88
64
22
10
12
26
24
28

DOOR HANDLE DISINFECTING/COVER DISPENSING SYSTEM

BACKGROUND OF THE INVENTION

1. Field of the Invention

The present invention relates to the general art of doors, and to the particular field of covers for door handles.

2. Discussion of the Related Art

Many people are reluctant to use public restrooms due to actual or perceived sanitary conditions of those restrooms. However, in some instances, such use is unavoidable.

These people try to avoid touching any surface after they have washed their hands. However, touching a surface of the restroom is nearly unavoidable because the person must touch the handle of the door to exit the restroom.

Some people carry gloves, wipes or the like to use in such public restrooms. Some people take an extra paper towel to use to cover the door handle. All of these techniques work, but are not efficient. Therefore, there is a need for a means and a method for efficiently and effectively covering a handle of a door so a person opening that door can avoid direct contact with the handle.

Covering a door handle is quite effective in preventing a person from contacting the door handle during operation of the door. However, there are times when it is also desirable to clean the door handle and disinfect the door handle. This generally requires a person to carry a liquid spray into a room, spray that liquid onto the door handle and then wipe the handle clean. This procedure requires a person to carry items with him or her for the cleaning procedure. This can be cumbersome and inefficient.

Therefore, there is a need for a means and a method for efficiently cleaning a handle of a door.

Still further, some people wonder when the last time a door handle was cleaned, and even if there is some form of protection for this person, they are uncomfortable touching the door handle. These people are not satisfied by the mere existence of some means for avoiding contact with the door handle.

Therefore, there is a need for a means and a method for efficiently cleaning a handle of a door which can be operated at any time by any user.

PRINCIPAL OBJECTS OF THE INVENTION

It is a main object of the present invention to provide a means and a method for efficiently and effectively covering a handle of a door so a person opening that door can avoid direct contact with the handle.

It is another object of the present invention to provide a means and a method for efficiently cleaning a handle of a door.

It is another object of the present invention to provide a means and a method for efficiently cleaning a handle of a door which can be operated at any time by any user.

SUMMARY OF THE INVENTION

These, and other, objects are achieved by a means and a method in which long tissues are stored in a dispenser housing superadjacent to a handle of a door. The tissues are dispensed in a known manner but are different from known tissues in that they are long enough to remain attached to the dispenser housing but to also cover a handle of a door. A spray system includes a spray nozzle on the housing and which is oriented to spray fluid from the housing onto the handle of the door.

The door handle protector of the present invention thus places tissues in position for anyone to use a tissue to grasp a door handle and thus avoid contact with the door handle. The protector also includes a spray system that the user can activate to spray cleaning fluid or disinfecting fluid onto the door handle at any time. The tissue can be used to wipe the handle dry. This will be convenient if the protector has run out of tissues. The handle can be cleaned before touching it and a degree of comfort can be obtained.

BRIEF DESCRIPTION OF THE DRAWING FIGURES

DETAILED DESCRIPTION OF THE PREFERRED EMBODIMENT

Figure 2:
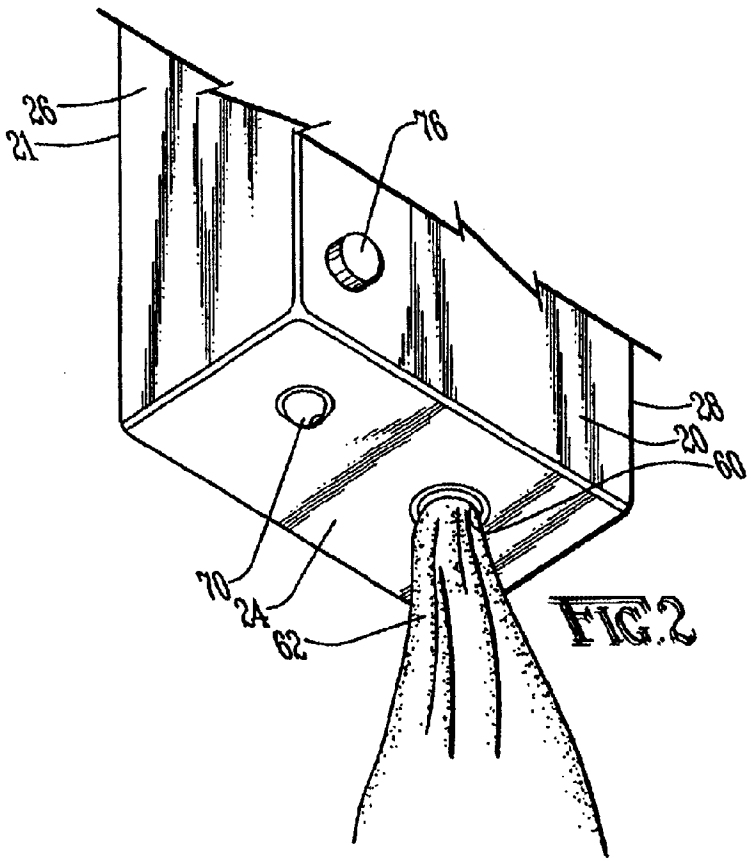
FIG. 2 is a bottom perspective view of a portion of the housing of the device embodying the present invention.

Other objects, features and advantages of the invention will become apparent from a consideration of the following detailed description and the accompanying drawings.

Referring to the figures, it can be understood that the present invention is embodied in a door handle protector 10. Door handle protector 10 comprises a door 12 having a handle 14 which is used to open and close the door 12. Handle 14 has a top end 15, a bottom end 16, and a length dimension 17 which extends between the top end 15 of the handle 14 and the bottom end 16 of the handle 14.

A housing 19 is mounted on the door 12 superadjacent to handle 14 of the door 12. Housing 19 includes a front wall 20, a rear wall 21, a top wall 22, a bottom wall 24, a first side wall 26, and a second side wall 28. An axial dimension 30 extends between the top wall 22 and the bottom wall 24, a width dimension 32 extends between the first side wall 26 and the second side wall 28, and a thickness dimension 34 extends between the front wall 20 and the rear wall 21.

An interior wall 40 extends between the top wall 22 and the bottom wall 24 in the direction of the axial dimension 30 of the housing 19. A liquid-containing compartment 42 is defined between first side wall 26 and interior wall 40 and between top wall 22 and bottom wall 24. A tissue-containing compartment 44 is defined between the interior wall 40 and the second side wall 28 and between the top wall 22 and the bottom wall 24. The rear wall 20 of the housing 19 is mounted on the door 12. A length dimension 18 is defined between the bottom wall 24 of the housing 19 and the bottom end 16 of the handle 14.

The housing 19 is mounted on the door 12 so that a dimension 45 is defined between the bottom of the housing 19 and the bottom of the handle 14.

A tissue-compartment cover 50 is removably mounted on the top wall 22 of the housing 19 between the interior wall 40 of the housing 19 and the second side wall 28 of the housing 19.

A liquid-compartment cover 52 is removably mounted on the top wall 22 of the housing 19 between the interior wall 40 of the housing 19 and the first side wall 26 of the housing 19.

As will be understood from the teaching of this disclosure, the covers 50 and 52 are removed to replenish either tissues or liquid contained in the housing 19.

A tissue-dispensing slot 60 is defined in the bottom wall 24 of the housing 19 between the interior wall 40 of the housing 19 and the second side wall 28 of the housing 19. Tissue-dispensing slot 60 is located superadjacent to the handle 14 of the door 12. Tissues 62 are dispensed through slot 60.

Figure 1:
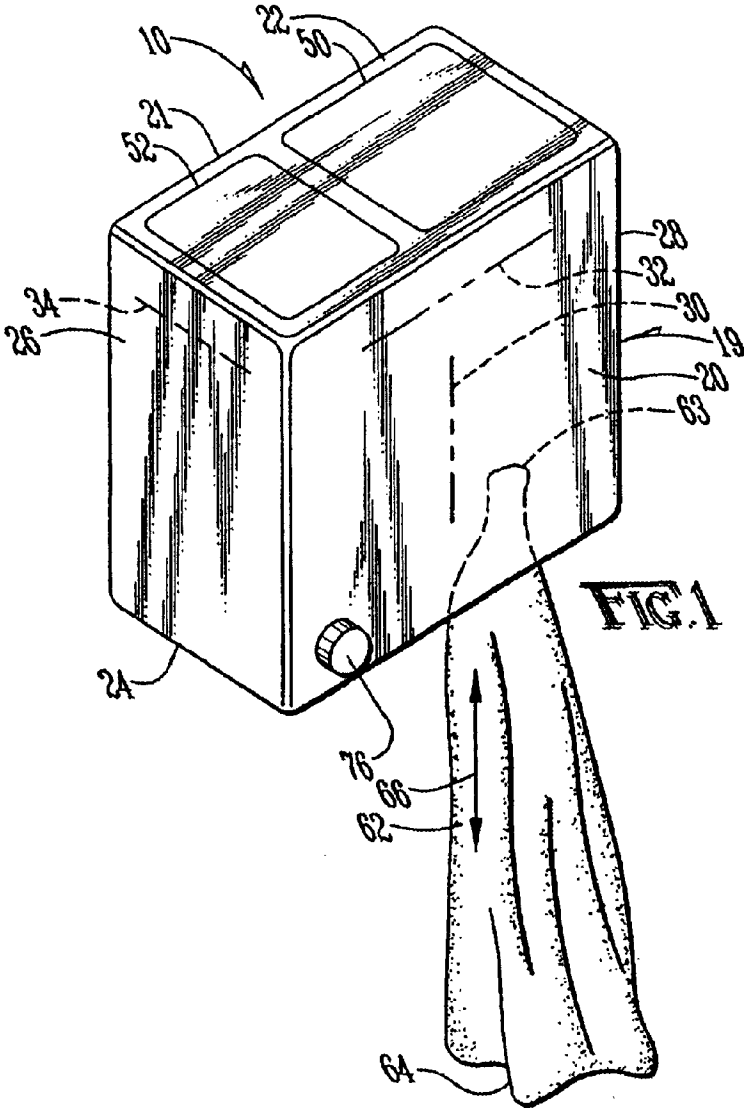
FIG. 1 is a perspective view showing the door handle protector dispensing unit embodying the present invention.
Figure 5:
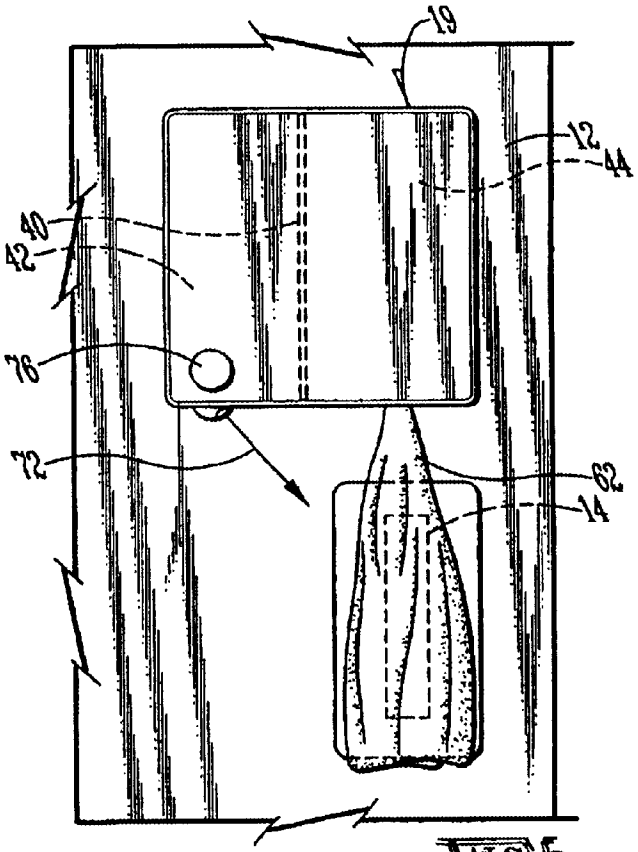
FIG. 5 is a front elevational view of the device embodying the present invention with a spray and a dispensed tissue being indicated.
Figure 4:
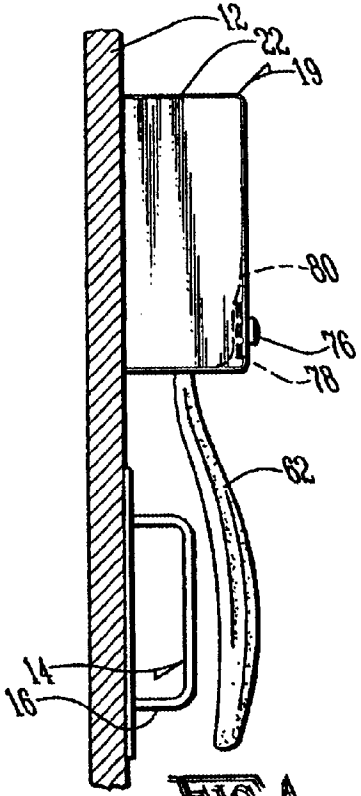
FIG. 4 is a side elevational view of the device embodying the present invention with a dispensed tissue being indicated.
Figure 3:
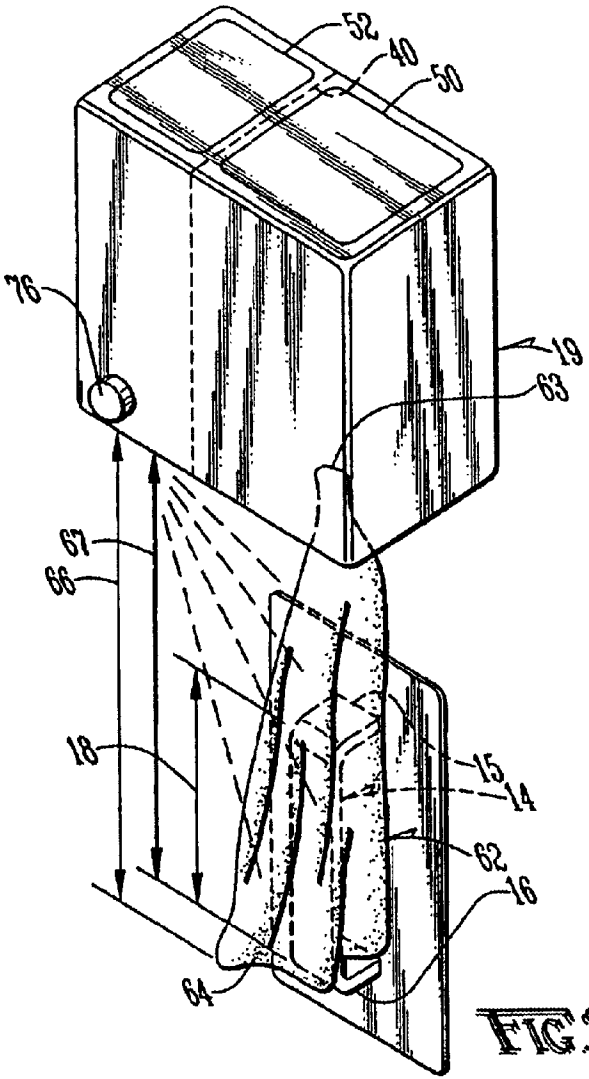
FIG. 3 is a partially perspective view showing the device embodying the present invention including a door and a door handle which is to be protected.

Tissue 62 includes a top 63 located inside compartment 44 and a bottom 64 located outside the tissue compartment 44 when the tissue 62 is in use. Tissue 62 has a length dimension 66 measured between the top 63 of the tissue 62 and the bottom 64 of the tissue 62. Length dimension 66 is greater than length dimension 67 defined between the bottom wall 24 of the housing 19 and the bottom end 16 of the handle 14. This length dimension 66 can be, for example more than one foot. Thus, when the tissue 62 is located outside of the housing 19 as shown in FIG. 1 with the top 63 of the tissue 62 still inside the housing 19, the length of the tissue 62 is sufficient to cover the handle 14 from the top 15 end of the handle 14 to the bottom end 16 of the handle 14 while the tissue 62 is still attached to the housing 19.

The length dimension 66 of the tissues 62 allows each tissue 62 to be dispensed in a known manner, but the tissue 62 will be long enough to cover the handle 14 of the door 12. This will permit a user to operate the door 12 using the handle 14 of the door 12 by grasping the handle 14 via the tissue 62 covering the handle 14. After opening the door 12, the user then simply pulls the tissue 62 out of the housing 19 and discards the tissue 62. As the tissue 62 exits the housing 19, it pulls the next tissue 62 down out of the dispensing slot 60 far enough so that this next tissue 62 covers, or at least partially covers, the handle 14 of the door 12 and is ready for the next user. If a tissue 62 does not fully cover the handle 14, a user can pull the tissue 62 out of the housing 19 far enough to cover the handle 14 of the door 12 while he or she is using the handle 14 to open the door 12.

A liquid dispenser nozzle 70 is located on the bottom wall 24 of the housing 19 between the interior wall 40 of the housing 19 and the first side wall 26 of the housing 19. The liquid dispenser nozzle 70 is a known type of nozzle and is fluidically connected to the liquid compartment 44 of the housing 19 to receive fluid therefrom. The liquid dispenser nozzle 70 is oriented to spray liquid in direction 72. Direction 72 is in the direction of the axial dimension 30 of the housing 19 away from the bottom wall 24 of the housing 19 and in a direction away from the first wall 26 of the housing 19 toward the second wall 28 of the housing 19 and is toward the handle 14 of the door 12 when the liquid dispenser nozzle 70 is activated. This spray will impinge on the handle 14 of the door 12.

The liquid sprayed on the handle 14 can be a cleaning liquid or a disinfecting liquid or the like. The liquid is sprayed on the handle 14 prior to a user grasping a tissue 62 and using that tissue 62 to grasp the handle 14 of the door 12. In this manner, the handle 14 can be cleaned and/or disinfected prior to a user grasping the handle 14. A tissue 62 will then dry the handle 14 as the user grasps the handle 14 via the tissue 62.

A spray-actuator button 76 is mounted on the front wall 20 of the housing 19 and suitable means, which includes elements such as movable wall 78 of a liquid-containing package 80 located in the housing 19 with the package 80 fluidically connected to the nozzle 70, connects the spray-actuator button 76 to the liquid dispenser nozzle 70 and to the liquid compartment 42 of the housing 19 to spray liquid contained in the liquid compartment 42 of the housing 19 from the liquid dispenser nozzle 70 when the spray-actuator button 76 is operated.

The present invention is also embodied in a method of protecting a door handle. As can be understood from the foregoing disclosure, the method comprises mounting a dispenser unit on a door superadjacent to a door handle used to open and close the door; spraying door handle cleaning liquid from the dispenser onto the door handle; dispensing a door handle covering tissue from the dispenser unit; covering the door handle with the tissue while the tissue is connected to the dispenser unit and forming a covered door handle; grasping the covered door handle via the tissue covering the door handle; opening the door using the covered door handle; after the door is opened, removing the tissue covering the door handle from the dispenser unit to form a removed tissue; as the removed tissue is removed from the dispenser unit, pulling another tissue out of the dispenser unit to replace the removed tissue; and discarding the removed tissue.

It is understood that while certain forms of the present invention have been illustrated and described herein, it is not to be limited to the specific forms or arrangements of parts described and shown.

What is claimed and desired to be covered by Letters Patent is:

1. A door handle protector comprising:

a) a door having a handle which is used to open and close said door, the handle having a top end and a bottom end and a length dimension extending between the top end of the handle and the bottom end of the handle;

b) housing mounted on said door superadjacent to the handle of said door, said housing having a front wall, a rear wall, a top wall, a bottom wall, a first side wall, a second side wall, an axial dimension extending between the top wall and the bottom wall, a width dimension extending between the first side wall and the second side wall, a thickness dimension extending between the front wall and the rear wall, an interior wall extending between the top wall and the bottom wall in the direction of the axial dimension of the housing, a liquid-containing compartment defined between the first side wall and the interior wall and between the top wall and the bottom wall, and a tissue-containing compartment defined between the interior wall and the first second side wall and between the top wall and the bottom wall, the rear wall of said housing being mounted on said door, said housing being mounted on said door and having a length dimension defined between the bottom wall of said housing and the bottom end of the handle;

c) a tissue-compartment cover removably mounted on the top wall of said housing between the interior wall of said housing and the second side wall of said housing;

d) a plurality of tissues stored in said tissue compartment, each tissue of said plurality of tissues having a top and a bottom and a length dimension defined between the top and the bottom, the length dimension of each tissue being greater than the length dimension defined between the bottom wall of said housing and the bottom end of the handle so that a tissue having a top end thereof located inside said tissue compartment will have a bottom end thereof located adjacent to the bottom end of said handle;

e) a liquid-compartment cover removably mounted on the top wall of said housing between the interior wall of said housing and the first side wall of said housing;

f) a tissue dispensing slot defined in the bottom wall of said housing between the interior wall of said housing and the second side wall of said housing, said tissue dispensing slot being located superadjacent to the top end of the handle of said door;

g) a liquid dispenser nozzle located on the bottom wall of said housing between the interior wall of said housing and the first side wall of said housing, the liquid dispenser nozzle being fluidically connected to the liquid compartment of said housing, said liquid dispenser nozzle being oriented to spray liquid in the direction of the axial dimension of said housing away from the bottom wall of said housing and in the direction away from the first wall of said housing toward the second wall of said housing and toward the handle of said door when activated;

h) a spray-actuator button mounted on the front wall of said housing; and i) means connecting said spray-actuator button to said liquid dispenser nozzle and to the liquid compartment of said housing to spray liquid contained in the liquid compartment of said housing from said liquid dispenser nozzle when said spray-actuator button is operated.

2. A method of protecting a door handle comprising:

a) mounting a dispenser unit on a door superadjacent to a door handle used to open and close the door;

b) spraying door handle cleaning liquid from the dispenser onto the door handle;

c) dispensing a door handle covering tissue from the dispenser unit;

d) covering the door handle with the tissue while the tissue is connected to the dispenser unit and forming a covered door handle;

e) grasping the covered door handle via the tissue covering the door handle;

f) opening the door using the covered door handle;

g) after the door is opened, removing the tissue covering the door handle from the dispenser unit to form a removed tissue;

h) as the removed tissue is removed from the dispenser unit, pulling another tissue out of the dispenser unit to replace the removed tissue; and i) discarding the removed tissue.

3. The door handle protector defined in claim 1 wherein the length dimension of each tissue is greater than one foot.

* * * * *